United States Patent [19]

Abrams

[11] 4,222,216

[45] Sep. 16, 1980

[54] OPENING OF ENVELOPE WITH DARKENED EDGES

[75] Inventor: Martin T. Abrams, Chicago, Ill.

[73] Assignee: AES Technology Systems, Inc., Elk Grove Village, Ill.

[21] Appl. No.: 9,246

[22] Filed: Feb. 5, 1979

[51] Int. Cl.[2] ..... B65B 43/26; B65B 69/00

[52] U.S. Cl. ..... 53/492; 83/912

[58] Field of Search ..... 53/492, 381 R, 382, 53/384; 162/158; 83/912; 432/230; 156/645, 152, 2, 236, 247

[56] References Cited

U.S. PATENT DOCUMENTS

| | | | |
|---|---|---|---|
| 2,032,645 | 3/1936 | Youtz | 162/158 X |
| 2,866,589 | 12/1958 | Zacker | 206/612 X |
| 2,992,629 | 7/1961 | Belopavlovich, Jr. | 53/381 R X |
| 3,116,718 | 1/1964 | Krupotich et al. | 53/381 R |
| 3,132,629 | 5/1964 | Krupotich | 53/381 R |
| 3,677,460 | 7/1972 | Whitman | 53/381 R X |
| 3,815,325 | 6/1974 | Berger | 53/381 R |
| 3,871,573 | 3/1975 | Whitman | 206/601 |
| 4,069,011 | 1/1978 | Gunther, Jr. | 432/230 |

*Primary Examiner*—Horace M. Culver

*Attorney, Agent, or Firm*—Dressler, Goldsmith, Shore, Sutker & Milnamow, Ltd.

[57] ABSTRACT

A process is provided for the opening of envelopes made of cellulosic paper by the action of a chemical degradation agent in the presence of radiant heat in which the radiant heat is generated from a source maintained at a temperature high enough to produce a substantial amount of radiation having a wave length of 2 microns or less and by applying to the edges to be opened a darkening material capable of absorbing a substantial portion of the incident radiant energy.

14 Claims, No Drawings

OPENING OF ENVELOPE WITH DARKENED EDGES

BACKGROUND OF THE INVENTION

In organizations receiving large amounts of mail, the opening of envelopes constitutes a substantial burden. To deal with this burden, mechanical envelope openers have been used which operate by cutting a thin strip from one edge of each envelope. Such openers sometimes damage the envelope contents because of variations in envelope size and the manner in which the contents are stuffed in the envelopes. Mechanical openers also produce large volumes of paper shavings from the high speed cutting of envelopes.

It has also been proposed to open envelopes by processes involving the chemical degradation of paper, and specifically of its cellulose, at at least one edge of the envelopes, and preferably at three edges thereof, followed by mild mechanical action to remove the degraded paper.

Zacker U.S. Pat. No. 2,866,589 discloses the degradation of cellulosic paper envelopes at their edges by chemical reagents, specifically by the action of nitric acid, sodium hydroxide, or sodium hypochlorite, or by the action of sulfuric acid followed by the application of heat.

Whitman U.S. Pat. No. 3,871,573 teaches the utilization of successive applications to the edges of an envelope of a sodium alkyl sulfate and an organic acid, such as oxalic acid or acetic acid, followed by the application of heat. Gunther, Jr. U.S. Pat. No. 4,069,011 discloses a similar system, utilizing tartaric acid in combination with the sodium alkyl sulfate. These systems produce sulfuric acid in situ.

Savit U.S. Patent application Ser. No. 946,347, filed Sept. 27, 1978, and coassigned herewith, teaches that a non-noxious organic acid having at least one pK value at room temperature between about 1.5 and about 5 may be used as the sole reactant with cellulose in the presence of heat to degrade an envelope edge so that it may be opened by mild mechanical action. Tartaric acid is the preferred organic acid.

A preferred method of applying heat to an envelope edge which has been treated with a chemical agent is to bring the envelope edgeinto close proximity to a source of radiation. Radiation heating does not require contact between the heat source and the envelope edge and thus permits easier handling in high speed processes. In addition, since the intensity of radiant heating varies inversely with the square of the distance between the radiant body and the surface to be heated, radiant heating from a source close to the envelope edge heats the envelope edge to a substantially greater degree than it heats other portions of the envelope located at greater distances from the radiant source.

Since cellulosic paper is inflammable when raised to ignition temperature and since it is essential to avoid burning or degrading the cellulosic paper beyond the edge or edges which are to be opened, it is essential that the heating step be controlled within the temperature range which is high enough to effectively degrade the chemically treated edge but not so high as to degrade the untreated cellulose beyond the treated edge. Time of exposure is also a factor in a high speed envelope opening system since the envelopes in such a system do not remain in close proximity to the radiant heat source for a long enough period to reach thermal equilibrium.

In a high speed envelope opening system of the type described above it is desired to degrade the cellulose at the envelope edges and to avoid degradation of the cellulose beyond the envelope edges. Different conditions must therefore prevail at each of these locations. As described above, the primary difference between the two locations is that the chemical degrading agent has been applied only to the edges; and the chemical degrading agent makes the cellulose much more susceptible to degradation under the action of an elevated temperature.

A second difference between degradation conditions at the envelope edges and other portions of the envelope is that the envelope edges are heated to a higher temperature than other portions due to the closer proximity of the edges to the radiant heat source. This temperature difference, however, is a gradual one, rather than a sharp drop-off; and is a relatively minor temperature difference when the plane of the envelope edges is not in the immediate vicinity of the heat source. It is therefore desirable to increase the temperature differential produced by the radiant heat source as between the envelope edges and the remaining portion of the envelopes beyond the edges.

It is also desirable to increase the efficiency of heat application to the envelope edges so that the required exposure times can be shortened, resulting in higher throughputs of envelopes through the process and resulting in energy savings on a per envelope basis.

SUMMARY OF THE INVENTION

In accordance with the present invention, the process of opening cellulosic paper at folded edges by the action of a chemical agent and exposure to a radiant heat source is improved by maintaining the temperature of the heat source at a level which will produce a substantial amount of radiation having a wave length of 2 microns or less and by applying to the edges to be opened a darkening material capable of absorbing a substantial portion of the incident radiant energy. Specifically, the heat source is maintained at a temperature level of at least 600° K., and preferably at least 2000° K. The darkening material is preferably a black, or very dark colored, dye or pigment capable when applied to white paper, of absorbing at least about 80% of incident radiation from a radiation source at 2500° K.

The preferred darkening material is a black, or substantially black pigment or dye, such as carbon black or nigrosine.

Infrared radiation in the wave length range of 5 to 20 microns is almost as strongly absorbed by white paper as by black (93% absorptance for white paper and 95% absorptance for lampblack). When a heat source is at a relatively low temperature, generating primarily infrared radiation in this range, the darkening of envelope edges will achieve substantially no enhancement of the differential conditions favoring cellulose degradation at the edges.

In contrast, there is a substantial difference in absorptance for radiation in the visible light range between black paper (about 94% absorbent) and white paper (about 30% absorbent). Thus, for a given exposure to energy from a radiant source about three times the energy in the visible light range is absorbed in a blackened area as compared to a white area on an envelope or other folded paper article. This more effective absorbency enables a blackened area to heat up much more quickly than an adjacent white area.

The process of this invention employs techniques known in the art in those portions of the process involving application of a chemical degradation agent to envelope edges followed by the application of heat thereto. The essential novelty of the process of this invention is in the darkening of the edges to be heated and in the selection of a radiant heat source generating a substantial portion of its radiation in a range which is largely reflected by white paper and largely absorbed by black, or darkened paper.

The preferred chemical degradation agent for cellulose in the practice of this invention is a non-noxious organic acid, such as tartaric acid, which has at least one pK value at room temperature between about 1.5 and about 5. Other suitable organic acids of this type include citric acid, succinic acid, pyruvic acid, malonic acid and acetic acid. Such acids are preferably utilized as the sole reactants with cellulose.

Other chemical degradation agents, known in the art, may be used, such as sulfuric acid, nitric acid, chromic acid, sodium hydroxide or sodium hypochlorite. These agents are less preferred because they are caustic materials, or because they produce noxious fumes and require careful handling. A combination of an organic acid an alkyl sodium sulfate, preferably applied in separate stages, may also be used, producing sulfuric acid in situ and also requiring careful handling for this reason.

The chemical degradation agent is generally applied to the envelope edges in an aqueous solution. To obtain optimum edge penetration, it is preferred that the solvent contain a water-miscible organic solvent, such as isopropanol. Good results have been obtained with tartaric acid dissolved in a solvent comprising 70 volume percent of water and 30 volume percent of isopropanol.

The chemical degradation agent may be applied to only one envelope edge, but it is preferred to apply it to three edges of a rectangular envelope for maximum ease of opening. The solution may be applied by brushing, dipping or rolling, but it is preferred to apply it in the form of a fine spray directed toward the edges of stacked envelopes.

The simplest, and the preferred, method of darkening the envelope edges is to incorporate a darkening material in the chemical degradation agent solution.

In processes, such as the process of Whitman U.S. Pat. No. 3,871,573, in which there is a twostage application of a chemical degradation agent produced in situ, the darkening agent may be incorporated with either the material applied in the first stage or the material applied in the second stage. It is also possible to apply the darkening material in its own solution or suspension, separate from any chemical degradation agent, or any component thereof.

After application of the chemical degradation agent and the darkening material to the stacked envelope edges, preferably together, the envelope edges are exposed to the action of a radiant heat source, such as a quartz radiation lamp. Preferably, three edges of the envelopes are exposed to the action of the radiant heat source, corresponding to the three edges to which the chemical degradation agent and the darkening material have been applied; and preferably the three edges are exposed to the heat source simultaneously.

The temperature of the radiant source should be at least about 600° K. if any descernible benefit is to be obtained from the darkening of the envelope edges, and should preferably be at least about 2000° K. for maximum benefit.

The distance of the envelope edges to the heat source and the time of exposure to the heat source are correlated to provide sufficient exposure for easy opening but not so much exposure as to constitute a fire hazard. The threshold exposure at which envelope opening becomes effective is substantially lower at darkened edges when higher radiant source temperatures are used.

After the envelope edges are exposed to the radiant heat source, they are subjected to a mild mechanical action, such as a riffling with a brush, to remove the degraded cellulose at the edges; and the envelope contents are thereafter easily removed.

EXAMPLES

For test purposes and to determine the effectiveness of the cellulose degradation at an envelope edge, a test device was constructed. The device comprised a spring dynamometer suspended from a firm base, having a horizontal bar suspended at one of its ends from the lower end of the dynamometer and a vertical bar suspended from the opposite end of the horizontal bar.

In the testing, a side of each test envelope was slit open and the interior of the envelope was placed over the horizontal bar, with the horizontal bar lying just under the interior of one uncut edge of the envelope and the vertical bar lying adjacent the interior of another uncut edge.

Three tartaric acid solutions were prepared, one which was clear, one which contained carbon black as a darkening agent, and one which contained nigrosine dye as a darkening agent. The clear solution contained 70 cc. of distilled water, 30 cc. of isopropanol, 20.5 g. of tartaric acid and one drop of a fluorinated surfactant. The carbon black and nigrosine preparations were made by adding 5% by weight of each of these materials to the clear solution.

In each test, twenty-five paper envelopes were held in a U-shaped holder along one of their long edges and one of the above solutions was sprayed onto a single edge of each envelope, the long edge opposite the holder. Each batch of envelopes was then held at a distance of one inch from a bank of four infrared lamps arranged parallel to each other in a reflector. The temperature of the lamps, and the time of heating are shown in the Table I below, as well as the nature of the solution applied to the envelopes.

After the heating step, the envelopes were separated, and sample envelopes were pulled downwardly by hand until the upper edge opened and the envelope slipped off the device while the readings on the dynamometer at the instant of opening were observed. Tests in which the treated envelope edge failed to open under a dynamometer reading of 450 grams were considered to be unsuccessful with respect to the achievement of ease of opening.

TABLE I

| Solution Applied | Temperature °F. | Temperature °K. | Time Exposed Seconds | Force To Open Grams | Observations |
|---|---|---|---|---|---|
| Clear | 525 | 546 | 5 | 450+ | Does not open |
| " | " | " | 10 | " | Does not open |
| " | " | " | 15 | " | Does not open |
| " | " | " | 20 | " | Does not open |
| " | 625 | 602 | 5 | " | Does not open |
| " | " | " | 10 | " | Does not open |

TABLE I-continued

| Solution Applied | Temperature °F. | Temperature °K. | Time Exposed Seconds | Force To Open Grams | Observations |
|---|---|---|---|---|---|
| " | " | " | 15 | " | Does not open |
| " | " | " | 20 | " | Does not open |
| " | 725 | 658 | 5 | " | Does not open |
| " | " | " | 10 | " | Does not open |
| " | " | " | 15 | " | Does not open |
| " | " | " | 20 | " | Does not open |
| Carbon Black | 525 | 546 | 5 | " | Does not open |
| " | " | " | 10 | " | Does not open |
| " | " | " | 15 | " | Does not open |
| " | " | " | 20 | " | Does not open |
| Carbon Black | 625 | 602 | 5 | 450+ | Does not open |
| " | " | " | 10 | " | Does not open |
| " | " | " | 15 | " | Does not open |
| " | " | " | 20 | 375 | Opened |
| " | 725 | 658 | 5 | 250 | Opened |
| " | " | " | 10 | zero | Opened |
| " | " | " | 15 | " | Hazard |
| " | " | " | 20 | " | Hazard |
| Nigrosine | 525 | 546 | 5 | 450+ | Does not open |
| " | " | " | 10 | " | Does not open |
| " | " | " | 15 | " | Does not open |
| " | " | " | 20 | " | Does not open |
| " | 625 | 602 | 5 | " | Does not open |
| " | " | " | 10 | " | Does not open |
| " | " | " | 15 | " | Does not open |
| " | " | " | 20 | 400 | Opened |
| " | 725 | 658 | 5 | 450+ | Does not open |
| " | " | " | 10 | " | Does not open |
| " | " | " | 15 | 400 | Opened |
| " | " | " | 20 | " | Opened |

As may be seen from the foregoing data, the presence of 5% of carbon black in the tartaric acid solution makes an envelope edge openable after 20 seconds of exposure to a radiant source at 602° K. and after only 5 seconds of exposure to a radiant source at 658° K. in contrast to envelopes to which a clear tartaric acid solution is applied which are not openable even after 20 seconds of exposure to a radiant source at 658° K. Similarly, the presence of 5% of nigrosine dye in the tartaric acid solution permits opening after 20 seconds of exposure to a radiant source at 602° K. or after 15 seconds of exposure to a radiant source at 658° K.

In other examples, the general testing procedure described above was carried out, except that the radiant energy source was a quartz halogen infrared lamp heated to 2500° K. The clear solution was similar to the clear solution described above and the darkened solutions contained varying amounts of nigrosine dye, as shown in Table II below. In addition, the envelope edge, wetted with the tartaric acid solution, was dried before exposure to the radiation by a 15 second exposure to a cylindrical fan blower.

In these tests, it was considered that failure to open the envelope at a pull of 500 grams represented an unsuccessful test. The term "easy" indicates opening of the envelope at substantially zero pull, and a range in the "Force To Open" column indicates variable results from envelope to envelope within the specified range.

TABLE II

| % Nigrosine in Solution | Exposure Time Seconds | Force to Open Grams |
|---|---|---|
| Zero | 5 | 500+ |
| " | 10 | 500+ |
| " | 15 | 500+ |
| " | 20 | Easy-200 |
| " | 25 | Easy |
| 2.5 | 5 | 500+ |
| " | 8 | 100-400 |

TABLE II-continued

| % Nigrosine in Solution | Exposure Time Seconds | Force to Open Grams |
|---|---|---|
| " | 10 | Easy |
| 5.0 | 3 | 500+ |
| " | 5 | 500+ |
| " | 8 | Easy-200 |
| " | 10 | Easy |
| 7.5 | 3 | 500+ |
| " | 5 | 200-500 |
| " | 8 | Easy-100 |
| " | 10 | Easy |
| 10.0 | 3 | 500+ |
| " | 5 | 500+ |
| " | 8 | Easy-350 |
| " | 10 | Easy-100 |

As may be seen, an envelope edge subjected to a tartaric solution containing nigrosine dye is rendered openable upon an 8-second exposure to the lamp radiating energy at 2500° K. in contrast to a failure with clear tartaric acid solution to become openable at 15 seconds and the necessity to go to 20 seconds before the envelopes become openable.

It may also be seen that the effect of the nigrosine dye on the openability of the envelopes improves with higher concentration of nigrosine as one goes from 2.5% to 5% to 7.5%, but falls back as one goes still higher to 10%. It is believed that the reversal of the beneficial effect at higher dye concentrations is due to the increased viscosity of the solution with consequent reduced penetration of the solution into the paper at the envelope edge.

It is preferred to limit the application of the darkening material and the chemical degradation agent at each edge to a thin line to avoid possible damage to the envelope contents. With envelopes reasonably tightly held in a clamp, the direction of a darkening spray toward the clamped edges can provide very restricted darkened areas, generally no wider than about one millimeter and preferably so narrow as to be hardly visible when looking at an envelope head on.

The preferred darkening agent with respect to its effectiveness in achieving the desired radiation absorbance is carbon black. However, carbon black does not dissolve in common solvents; and carbon black particles may tend to clog a spray nozzle. Thus, for spray application purposes, the preferred darkening agent is nigrosine, which is readily soluble at concentrations high enough to be useful.

It is contemplated that the foregoing method will find its greatest applicability in the opening of envelopes as described above. It will be obvious, however, that it is applicable to any severing of cellulosic paper at a folded edge thereof. It is applicable, for example, to separate the segments of a fanfold from each other at the folded edges thereof, treating the folded edges in the manner described above for treating the edges of an envelope.

The invention has been described with respect to its preferred embodiments. Those skilled in the art will understand that other variations and modifications may be employed without departing from the essence of this invention.

What is claimed is:

1. In the method of opening envelopes made of cellulosic paper in which at least one chemical degradation agent is applied to at least one edge of each envelope followed by the application of heat and mild mechanical action thereto and said heat is generated from a radiant source, the improvement wherein said radiant source is maintained at a temperature which generates a substantial amount of radiation at a wave length not higher than about 2 microns and wherein there is applied to at least said one edge a darkening material capable, when applied to white paper, of absorbing at least 80% of incident radiation from a radiation source at 2500° K.

2. The method of claim 1 wherein said radiant source is at a temperature of at least 600° K.

3. The method of claim 1 wherein said radiant source is at a temperature of at least 2000° K.

4. The method of claim 1 wherein said darkening material is carbon black.

5. The method of claim 1 wherein said darkening material is nigrosine.

6. The method of claim 1 wherein said darkening material is applied together with said chemical degradation agent from a single liquid composition.

7. The method of claim 6 wherein said chemical degradation agent is tartaric acid.

8. The method of claim 7 wherein said composition comprises a solvent comprising water and isopropanol.

9. The method of claim 6 wherein said composition is applied to said each envelope at at least one edge by a spray directed toward the edges of a stack of envelopes.

10. The method of claim 1 wherein said chemical degradation agent and said darkening agent are applied to three sides of each envelope.

11. In the method of opening envelopes made of cellulosic paper in which tartaric acid in solution in a solvent comprising water and isopropanol is applied to three edges of each envelope followed by the application of heat and mild mechanical action thereto and said heat is generated from a radiant source, the improvement wherein said radiant source is maintained at a temperature of at least 2000° K. and wherein said solution contains a darkening material capable, when applied to white paper, of absorbing at least 80% of incident radiation from a radiation source at 2500° K.

12. The method of claim 11 wherein said darkening material is carbon black.

13. The method of claim 11 wherein said darkening material is nigrosine.

14. In the method of severing cellulosic paper at a fold therein in which at least one chemical degradation agent is applied to said fold followed by the application of heat and mild mechanical action thereto and said heat is generated from a radiant source, the improvement, wherein said radiant source is maintained at a temperature which generates a substantial amount of radiation at a wave length not higher than about 2 microns and wherein there is applied to said fold a darkening material capable, when applied to white paper, of absorbing at least 80% of incident radiation from a radiation source at 2500° K.

* * * * *